US011473582B2

(12) United States Patent
Sadakata et al.

(10) Patent No.: US 11,473,582 B2
(45) Date of Patent: *Oct. 18, 2022

(54) PACKAGE-TYPE COMPRESSOR

(71) Applicant: Hitachi Industrial Equipment Systems Co., Ltd., Tokyo (JP)

(72) Inventors: Kosuke Sadakata, Tokyo (JP); Toshikazu Harashima, Tokyo (JP); Hitoshi Nishimura, Tokyo (JP); Kentaro Yamamoto, Tokyo (JP); Masahiko Takano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 25 days.

This patent is subject to a terminal disclaimer.

(21) Appl. No.: 17/127,473

(22) Filed: Dec. 18, 2020

(65) Prior Publication Data

US 2021/0102540 A1 Apr. 8, 2021

Related U.S. Application Data

(63) Continuation of application No. 16/084,071, filed as application No. PCT/JP2016/063704 on May 9, 2016, now Pat. No. 10,907,636.

(51) Int. Cl.
*F04C 29/04* (2006.01)
*F04B 39/06* (2006.01)
(Continued)

(52) U.S. Cl.
CPC ..... *F04C 29/04* (2013.01); *F04B 35/04* (2013.01); *F04B 39/066* (2013.01);
(Continued)

(58) Field of Classification Search
CPC .... F04C 29/04; F04C 29/047; F04C 2240/30; F04B 39/06; F04B 39/066; F04B 39/121;
(Continued)

(56) References Cited

U.S. PATENT DOCUMENTS 3,989,415 A * 11/1976 Van-Hee ..... G10K 11/16 181/224
4,264,282 A * 4/1981 Crago ..... F04B 39/0038 417/243
(Continued)

FOREIGN PATENT DOCUMENTS

BE 1013684 A3 6/2002
JP 6-346875 A 12/1994
(Continued)

OTHER PUBLICATIONS

International Search Report (PCT/ISA/210) issued in PCT Application No. PCT/JP2016/063704 dated Aug. 9, 2016 with English translation (three (3) pages).
(Continued)

*Primary Examiner* — Christopher S Bobish
(74) *Attorney, Agent, or Firm* — Crowell & Moring LLP

(57) ABSTRACT

A package-type compressor includes a body unit, a controller, a casing, a first cooling air inlet, a second cooling air inlet, a cooling air outlet, a fan duct, a cooling fan, an air cooling type heat exchanger, a machine chamber, and a cooling duct. The cooling duct is provided below the fan duct, the cooling duct causing the cooling air taken in at the second cooling air inlet to flow along the controller toward the suction port of the fan duct. A vertical projection plane of the cooling fan overlaps the machine chamber and the cooling duct.

14 Claims, 11 Drawing Sheets

(51) Int. Cl.

| | |
|---|---|
| ***F04B 53/00*** | (2006.01) |
| ***F04B 53/08*** | (2006.01) |
| ***F04B 39/12*** | (2006.01) |
| ***F24F 13/20*** | (2006.01) |
| ***F04B 35/04*** | (2006.01) |

(52) U.S. Cl.
CPC ..... *F04B 53/002* (2013.01); *F04B 53/08* (2013.01); *F04C 29/047* (2013.01); *F04B 39/06* (2013.01); *F04B 39/121* (2013.01); *F04C 2240/30* (2013.01); *F24F 2013/202* (2013.01); *F24F 2013/205* (2013.01)

(58) Field of Classification Search
CPC ... F04B 53/08; F04B 53/002; F24F 2013/202; F24F 2013/205
See application file for complete search history.

(56) References Cited

U.S. PATENT DOCUMENTS

| | | | | | |
|---|---|---|---|---|---|
| 4,420,293 | A * | 12/1983 | Hofmann | F04C 23/00 | 418/101 |
| 4,492,533 | A * | 1/1985 | Tsuge | F04B 39/066 | 417/372 |
| 4,836,755 | A * | 6/1989 | Nitsche | F04B 35/04 | 417/415 |
| 4,929,161 | A * | 5/1990 | Aoki | F04C 29/04 | 418/101 |
| 5,240,648 | A * | 8/1993 | Gill | B01F 23/21 | 417/372 |
| 5,507,618 | A * | 4/1996 | Kubo | F04C 23/00 | 417/372 |
| 5,672,052 | A * | 9/1997 | Ishida | F04D 29/664 | 417/423.5 |
| 5,709,175 | A * | 1/1998 | Carroll | F02B 77/13 | 123/41.66 |
| 5,947,711 | A * | 9/1999 | Myers | F01C 21/007 | 418/101 |
| 6,220,825 | B1 * | 4/2001 | Myers | F04C 23/00 | 417/313 |
| 6,447,264 | B1 * | 9/2002 | Lucas | F04B 39/066 | 417/313 |
| 6,790,012 | B2 * | 9/2004 | Sharp | F04B 39/0033 | 417/313 |
| 6,793,465 | B2 * | 9/2004 | Stallings | F04B 39/0033 | 417/313 |
| 8,303,271 | B2 * | 11/2012 | Ikeda | F04C 29/045 | 417/366 |
| 9,554,482 | B2 * | 1/2017 | Wilson | H02K 7/1815 | |
| 10,181,770 | B2 * | 1/2019 | Janscha | F02M 35/1015 | |
| 10,550,841 | B2 * | 2/2020 | Kasahara | F04C 18/16 | |
| 10,704,552 | B2 * | 7/2020 | Seaver | F04C 23/001 | |
| 2011/0256002 | A1 * | 10/2011 | Ikeda | F04B 35/04 | 417/410.1 |
| 2016/0097389 | A1 * | 4/2016 | Yamazaki | F04C 29/04 | 417/410.5 |

FOREIGN PATENT DOCUMENTS

| | | | |
|---|---|---|---|
| JP | 2000-111216 | A | 4/2000 |
| JP | 2009-52856 | A | 3/2009 |
| JP | 2012-122487 | A | 6/2012 |

OTHER PUBLICATIONS

Japanese-language Written Opinion (PCT/ISA/237) issued in PCT Application No. PCT/JP2016/063704 dated Aug. 9, 2016 (four (4) pages).

International Preliminary Report on Patentability (PCT/IB/338 & PCT/IB/373) issued in PCT Application No. PCT/JP2016/063704 dated Nov. 22, 2018, including English translation of document C2 (Japanese-language Wrillen Opinion (PCT/ISA/237) previously filed on Sep. 11, 2018) (eight (8) pages).

Extended European Search Report issued in counterpart European Application No. 16901591.4 dated Sep. 19, 2019 (seven (7) pages).

* cited by examiner

PACKAGE-TYPE COMPRESSOR

CROSS REFERENCE TO RELATED APPLICATIONS

This application is a continuation of U.S. patent application Ser. No. 16/084,071, filed Sep. 11, 2018, which is a 371 of International Application No. PCT/JP2016/063704, filed May 9, 2016, the disclosures of which are expressly incorporated by reference herein.

TECHNICAL FIELD

The present invention relates to a package-type compressor.

BACKGROUND ART

Patent Document 1 discloses a package-type compressor having a casing accommodating a body unit, an oil separator, a controller, a heat exchanger, a cooling fan device, etc. The compressor will be described in detail.

The body unit has a compressor body compressing air and a motor driving this compressor body, with the compressor body and the motor being integrated. More specifically, the compressor body and the motor are vertically installed such that the rotation shaft of the compressor body and the drive shaft of the motor extend in the vertical direction, with the motor being connected to the upper side of the compressor body.

At the lower portion of the right-hand side surface of the casing, there is formed an air suction port, and there are provided a first duct adjacent to a portion of the air suction port and a second duct adjacent to another portion of the air suction port. At the left-hand side surface side of the casing, there is provided a third duct extending in the vertical direction. The heat exchanger is provided at the lower portion of the third duct, and the cooling fan device is provided at the upper portion of the third duct. An air discharge port is formed in the upper surface of the casing.

The cooling fan device is equipped with a case having a suction port and a delivery port, a cooling fan (centrifugal fan) accommodated in the case, and a fan motor driving the cooling fan. The cooling fan and the fan motor are arranged such that their rotation shafts extend in the horizontal direction. The suction port of the case is connected to the third duct, and the delivery port of the case is connected to the air discharge port. The cooling fan device induces a flow of the cooling air inside the casing (more specifically, a flow of the cooling air sucked in through the air suction port and discharged through the air discharge port).

The first duct guides the cooling air from the air suction port to the motor of the body unit to cool the motor. The second duct causes the cooling air from the air suction port to flow along the controller to cool the controller. The cooling air having cooled the motor and the controller cools the heat exchanger. After this, the cooling air heads for the cooling fan device via the third duct.

PRIOR ART DOCUMENT

Patent Document

Patent Document 1: JP-1994-346875-A

SUMMARY OF THE INVENTION

Problem to be Solved by the Invention

In the prior-art technique disclosed in Patent Document 1, the compressor body and the motor of the body unit are vertically installed, with the compressor body and the motor being connected together in the vertical direction so as to be integrated with each other. As a result, it is possible to achieve a reduction in the installation area of the body unit and, by extension, a reduction in the installation area of the package-type compressor. Further, although not described in Patent Document 1, when the cooling air is caused to flow in the vertical direction along the body unit, it is possible to efficiently cool the body unit.

In the prior-art technique described in Patent Document 1, however, the air suction port is formed solely in one side surface of the casing, and there are limitations to the size of the air suction port due to a restriction such as sound insulation. Further, the flow path of the cooling air, which extends from the air suction port via the first or second duct and further extends to the air discharge port via the third duct, is relatively long, and the pressure loss of the cooling air flow path is relatively large. Thus, it is difficult to increase the flow rate of the cooling air cooling the body unit and the flow rate of the cooling air cooling the controller. Further, it is difficult to balance the flow rate of the cooling air in the first duct and that in the second duct, and it is difficult to increase the flow rate of the cooling air of the second duct (i.e., the flow rate of the cooling air cooling the controller). Thus, there is room for an improvement in terms of the cooling performance for cooling the body unit and the controller.

The present invention has been made in view of the above problem. It is an object of the present invention to achieve an improvement in terms of the cooling performance for cooling the body unit and the controller.

Means for Solving the Problem

To achieve the above object, the structure as claimed in the appending claims is applied. The present invention includes a plurality of means for solving the above problem, an example of which is a package-type compressor including: a body unit which has a compressor body compressing a gas and a motor driving the compressor body and in which the compressor body and the motor are vertically connected to be integrated while vertically installing the compressor body and the motor such that a rotation shaft of the compressor body and a drive shaft of the motor extend vertically; a controller controlling the motor; a casing accommodating the body unit and the controller at a lower portion thereof; a first cooling air inlet formed in one side surface of the casing; a second cooling air inlet formed in another side surface of the casing; a cooling air outlet formed in an upper surface of the casing; a fan duct provided at an upper portion of the casing and having a suction port at a lower surface and a delivery port at an upper surface; a cooling fan accommodated in the fan duct and arranged such that a rotation shaft extends in a vertical direction, the cooling fan inducing a flow of cooling air taken in through the first and second cooling air inlets and discharged through the cooling air outlet; an air cooling type heat exchanger arranged above the delivery port of the fan duct and below the cooling air outlet; a machine chamber that is provided below the fan duct and accommodates the body unit and that causes the cooling air taken in at the first cooling air inlet to flow along the body unit and to head for the suction port of the fan duct; and a cooling duct that is provided below the fan duct and that causes the cooling air taken in at the second cooling air inlet to flow along the controller and to head for the suction port of the fan duct, wherein a center position of the suction port of the fan duct is offset away from the first cooling air inlet and toward the second cooling air inlet with respect to a center position of the drive shaft of the motor.

Effect of the Invention

In accordance with the present invention, it is possible to achieve an improvement in terms of the cooling performance for cooling the body unit and the controller.

Other objects, structure, and effects of the present invention will become apparent from the following description.

MODES FOR CARRYING OUT THE INVENTION

Figure 1:
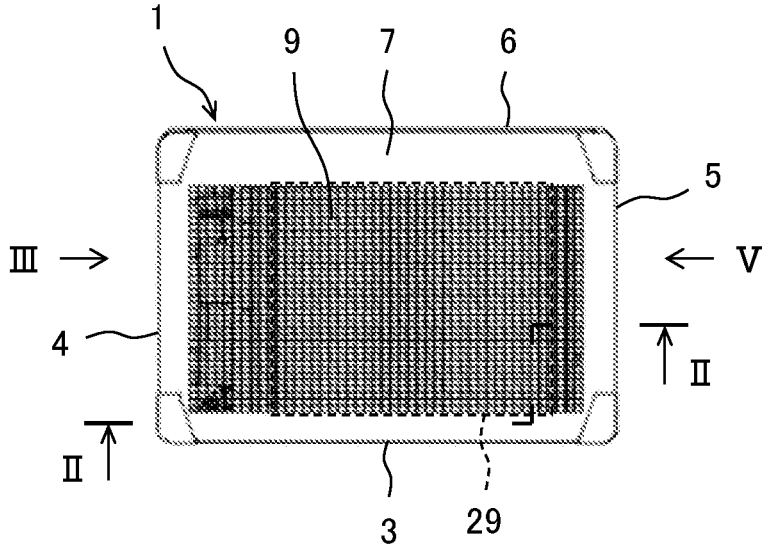
FIG. 1 is a top view of a package-type compressor according to an embodiment of the present invention.

An embodiment of the present invention will be described with reference to FIGS. 1 through 14.

A package-type compressor according to the present embodiment is equipped with a casing 1 accommodating apparatuses and components described below. The casing 1 is equipped with a base 2, a front panel 3, a left-hand side panel 4, a right-hand side panel 5, a back panel 6, and a top panel 7. The front panel 3 is provided with an operation switch (not shown), a monitor, etc. The left-hand side panel 4 has a cooling air inlet 8A (first cooling air inlet/inlet port) at the lower side thereof, and has a cooling air inlet 8C (third cooling air inlet/inlet port) at the upper side of the cooling air inlet 8A. The right-hand side panel 5 has a cooling air inlet 8B (second cooling air inlet/inlet port) at the lower side thereof. The top panel 7 has a cooling air outlet 9. Each panel is detachable to allow maintenance of the apparatuses accommodated in the casing 1. In the present embodiment, the opening area of the cooling air inlet 8B is smaller than the opening area of the cooling air inlet 8A.

The casing 1 has a machine chamber 10 at its lower portion, and the machine chamber 10 accommodates a body unit 11 and a suction filter 12. The suction filter 12 is arranged on the front side of the machine chamber 10 (the right-hand side in FIG. 4, and the lower side in FIG. 14).

The body unit 11 has an oil feeding type compressor body 13, a motor 14 driving the compressor body 13, and an oil separator 15 (gas-liquid separator) separating oil from the compressed air (compressed gas) delivered from the compressor body 13, and the compressor body 13, the motor 14, and the oil separator 15 are integrated with each other. More specifically, the compressor body 13 and the motor 14 are vertically installed such that the rotation shaft of the compressor body 13 and the drive shaft (rotation shaft) of the motor 14, described below, extend in the vertical direction. In the body unit 11, the motor 14 is arranged on the upper side of the compressor body 13, and the oil separator 15 is arranged on the lower side of the compressor body 13.

The motor 14 is an axial gap type motor. This motor 14 has a drive shaft 16 extending in the vertical direction, motor rotors 17A and 17B mounted to the drive shaft 16 so as to be spaced away from each other in the axial direction, a stator 18 arranged between the motor rotors 17A and 17B, and a motor casing 19 to which the stator 18 is mounted.

The compressor body 13 is a screw compressor. This compressor body 13 is equipped with: a male rotor 20A and a female rotor 20B in mesh with each other; a compressor body casing 21 accommodating the tooth portions of the screw rotors 20A and 20B and forming a compression chamber in their tooth grooves; and a suction side casing 22 connected between the compressor body casing 21 and the motor casing 19. The suction side casing 22 has a suction port 23, and the compressor body casing 21 has a suction flow path (not shown). The compressor body casing 21 has a delivery port and a delivery flow path (not shown). A suction filter 12 is connected to the suction route of the compressor body casing 21 via piping (not shown).

The rotation shafts of the male rotor 20A and the female rotor 20B extend in the vertical direction, and the male rotor 20A is integrally formed with or connected to the drive shaft 16 of the motor 14. When the drive shaft 16 of the motor 14 rotates, the male rotor 20A and the female rotor 20B rotate, and the compression chamber moves downwards. The compression chamber sucks in air from the suction flow path via the suction port 23, compress the air, and deliver the compressed air into the delivery flow path via the delivery port.

The oil separator 15 is equipped with an outer cylinder 24 and an inner cylinder 25 that are integrally formed with or connected to the compressor body casing 21, and an oil storage portion 26 provided on the lower side of the outer cylinder 24. The inner cylinder 25 is arranged at or near the center of the upper portion of the outer cylinder 24, and a swirl flow path is formed between the outer cylinder 24 and the inner cylinder 25. This swirl flow path is connected to the delivery flow path of the compressor body 13. The compressed air delivered from the compressor body 13 swirls along the swirl flow path, and the oil contained in the compressed air is centrifugally separated. The separated oil falls along the outer cylinder 24, and is accumulated in the oil storage portion 26. The oil accumulated in the oil storage portion 26 is supplied into the suction flow path or the compression chamber of the compressor body 13 via an oil cooler described below.

On the other hand, the separated compressed air flows into the inner side of the inner cylinder 25, and is supplied to an air cooler described below via a flow path and piping, which are not shown. After this, the compressed air is supplied to a dryer described below.

The casing 1 has a fan duct 27 in the upper portion thereof (in other words, above the machine chamber 10). The fan duct 27 is formed by a lower plate, a front plate, a left-hand side plate, a right-hand side plate, a back plate, and an upper plate. The lower plate of the fan duct 27 (in other words, the partition plate defining the machine chamber 10) has a suction port 28 (see FIGS. 12 and 14), and the upper plate of the fan duct 27 (in other words, the support plate supporting the heat exchanger described below) has a delivery port 29 (see FIG. 1).

The fan duct 27 accommodates a turbo fan 30 (cooling fan) and a fan motor 31 driving the turbo fan 30. The turbo fan 30 and the fan motor 31 are arranged such that their rotation shafts extend in the vertical direction. The turbo fan 30 is a kind of centrifugal fan, and is formed by an upper shroud, a lower shroud, and a plurality of vanes provided between them. As indicated by arrows A, B, and C of FIG. 13, the turbo fan 30 induces a cooling air flow which is taken in through the cooling air inlets 8A and 8B and discharged through the cooling air outlet 9. In other words, it takes in external air and generates cooling air flowing through the casing 1.

Above the delivery port 29 of the fan duct 27 and below the cooling air outlet 9, there is arranged an air cooling type heat exchanger 32. The heat exchanger 32 has an oil cooler and an air cooler as mentioned above. The heat exchanger 32 is, for example, made of aluminum or formed by a copper pipe and an aluminum plate. The cooling air delivered through the delivery port 29 of the fan duct 27 cools the heat exchanger 32, and is then discharged through the cooling air outlet 9 (see arrows C in FIG. 13).

Figure 2:
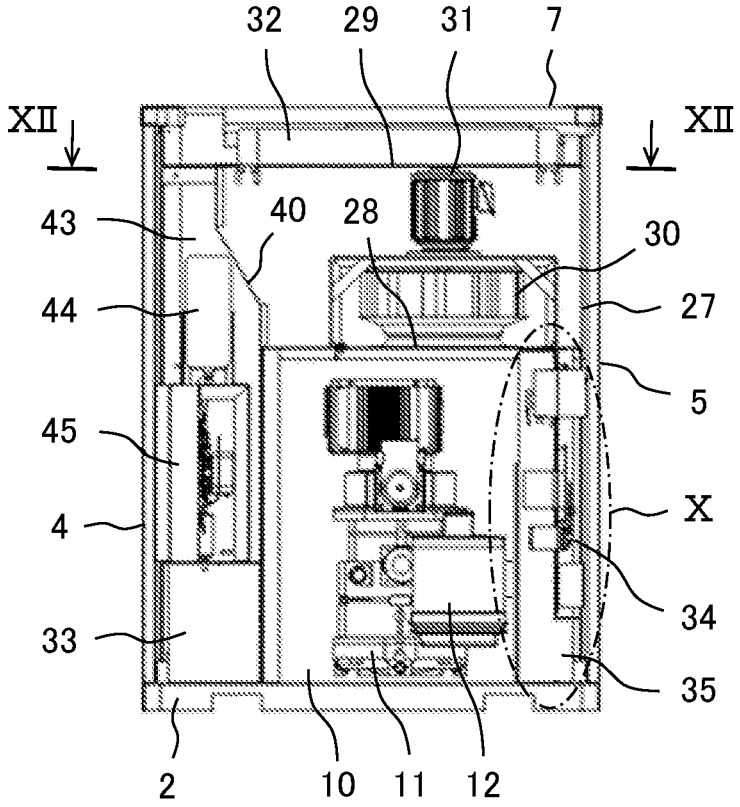
FIG. 2 is a vertical sectional view of the package-type compressor taken along a line II-II of FIG. 1.
Figure 3:
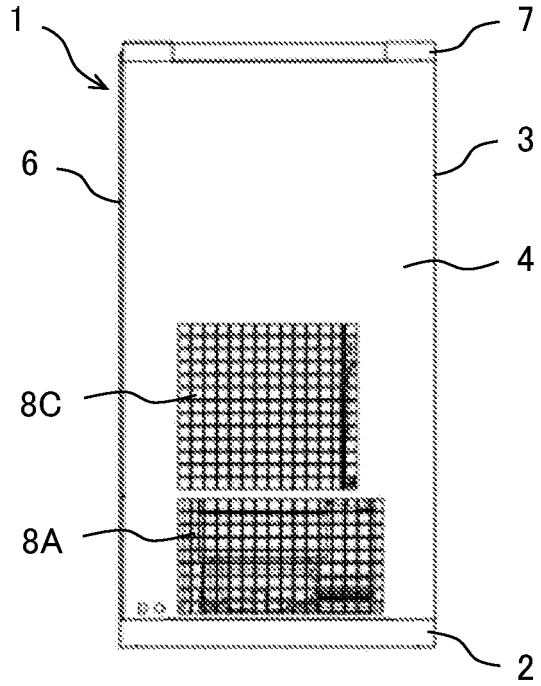
FIG. 3 is a left-hand side view of the package-type compressor as seen from the direction of an arrow III of FIG. 1.
Figure 4:
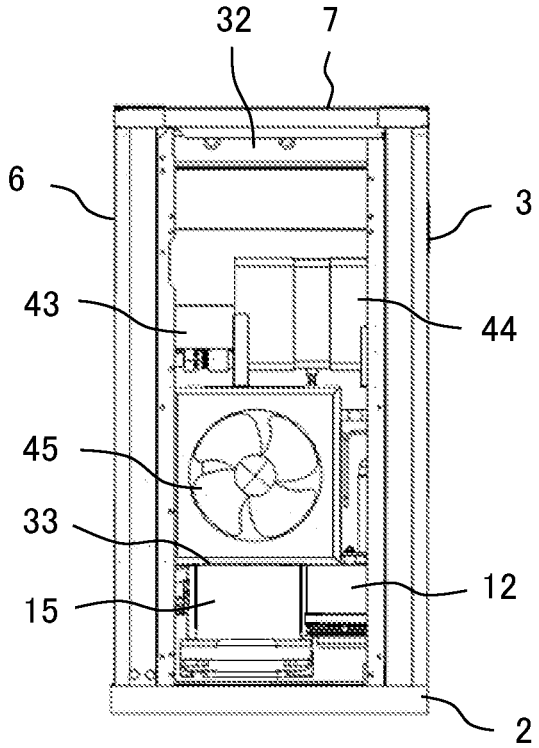
FIG. 4 is a left-hand side view of the package-type compressor with a left-hand side panel shown in FIG. 3 removed.
Figure 5:
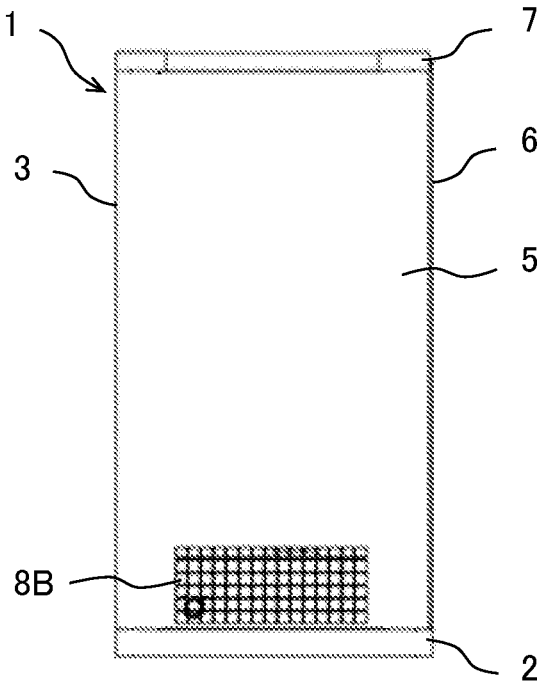
FIG. 5 is a right-hand side view of the package-type compressor as seen from the direction of an arrow V of FIG. 1.

On the left-hand side (the left-hand side in FIG. 2) of the machine chamber 10, there is arranged an introduction duct 33. As shown in FIG. 4, the introduction duct 33 is of substantially the same sectional configuration as the cooling air inlet 8A, and extends in the horizontal direction between the cooling air inlet 8A and the machine chamber 10 as shown in FIG. 2. The cooling air taken in at the cooling air inlet 8A flows into the lower portion of the machine chamber 10 via the introduction duct 33, and flows along the body unit 11 in the machine chamber 10 before heading for the suction port 28 of the fan duct (see arrows A in FIGS. 13 and 14). As a result, the body unit 11 is efficiently cooled. The introduction duct 33 also serves to support a dryer, a dryer cooling fan, etc. mentioned below.

On the right-hand side (the right-hand side in FIG. 2) of the machine chamber 10, there are arranged a control panel 34 (controller) controlling the motor 14, etc. and a cooling duct 35 adjacent to the control panel 34 (in other words, covering the control panel 34). The control panel 34 has an inverter 36 performing variable control on the rotation speed of the motor 14, and a capacitor (electric storage device) 37. A heat sink 38 of the inverter 36 and a part of the capacitor 37 protrude into the cooling duct 35. While in the present embodiment there are provided two sets of inverters 36 and capacitors 37, it is also possible to provide one set or three or more sets of them.

Figure 6:
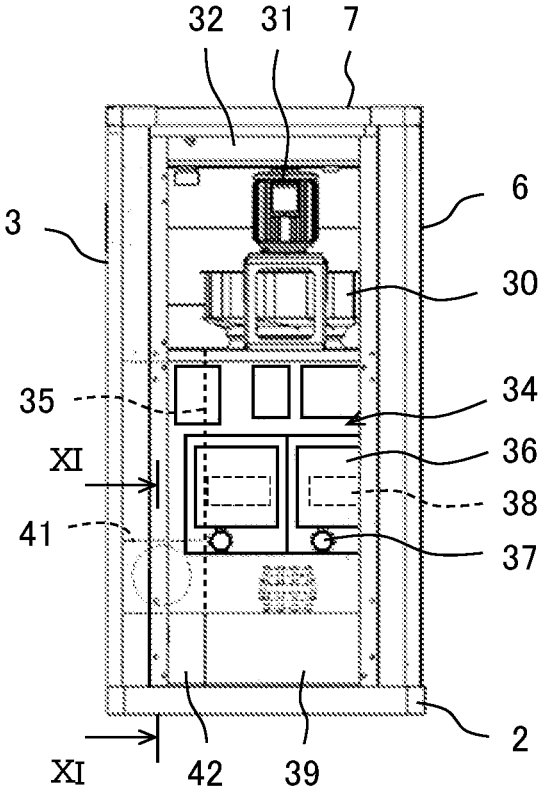
FIG. 6 is a right-hand side view of the package-type compressor with a right-hand side panel shown in FIG. 5 removed.
Figure 7:
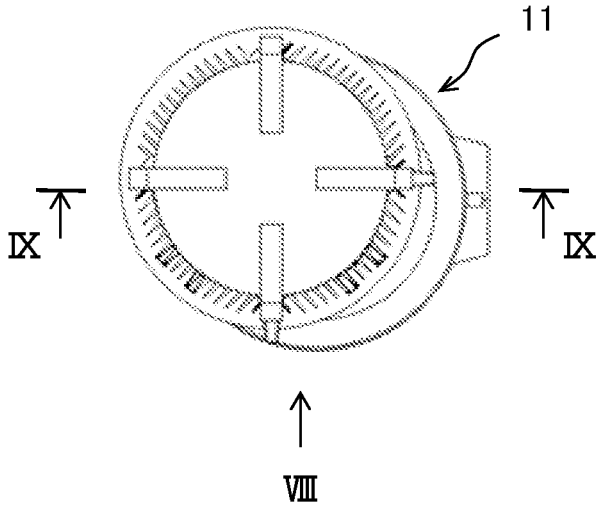
FIG. 7 is a top view of a body unit according to the embodiment of the present invention.
Figure 8:
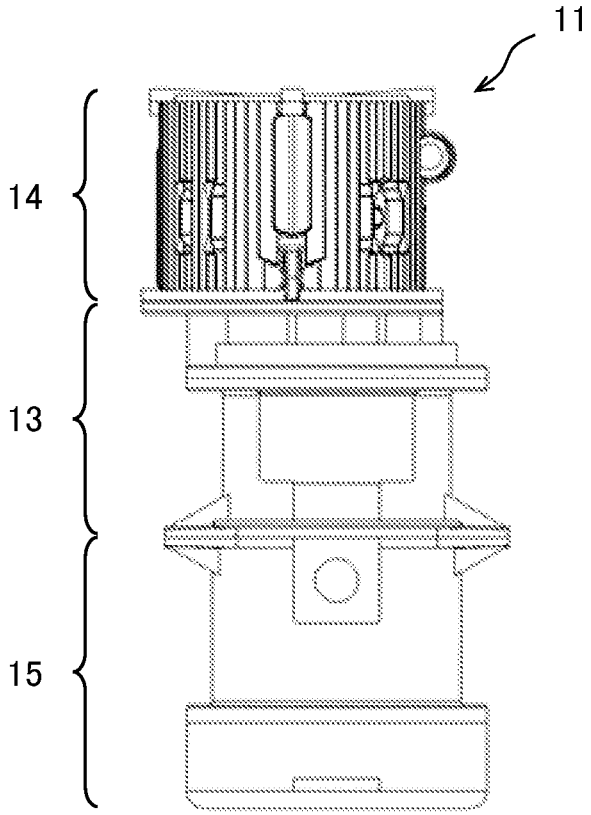
FIG. 8 is a front view of the body unit as seen from the direction of an arrow VIII of FIG. 7.
Figure 9:
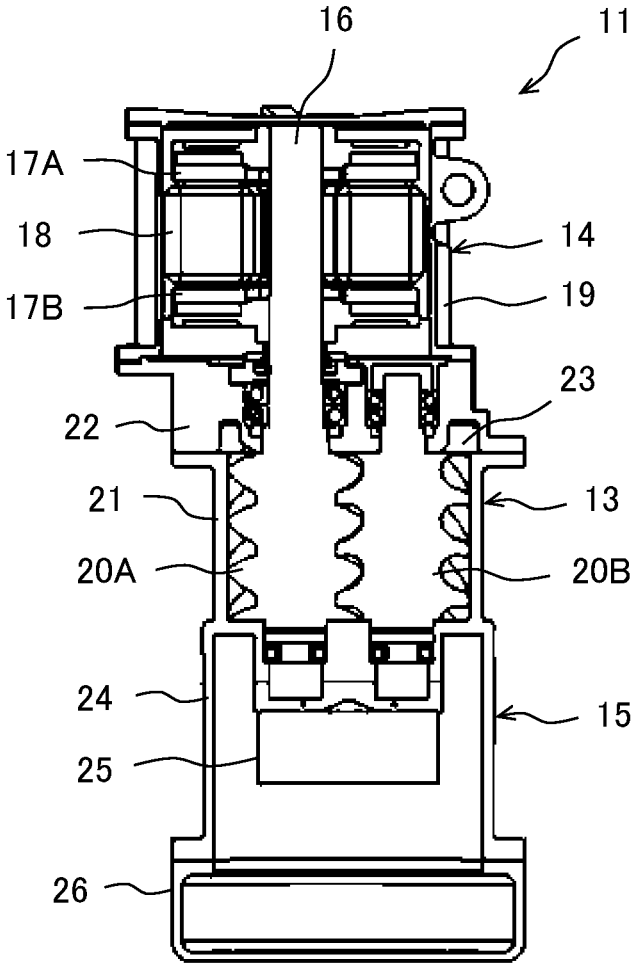
FIG. 9 is a vertical sectional view of the body unit taken along a line IX-IX of FIG. 7.
Figure 10:
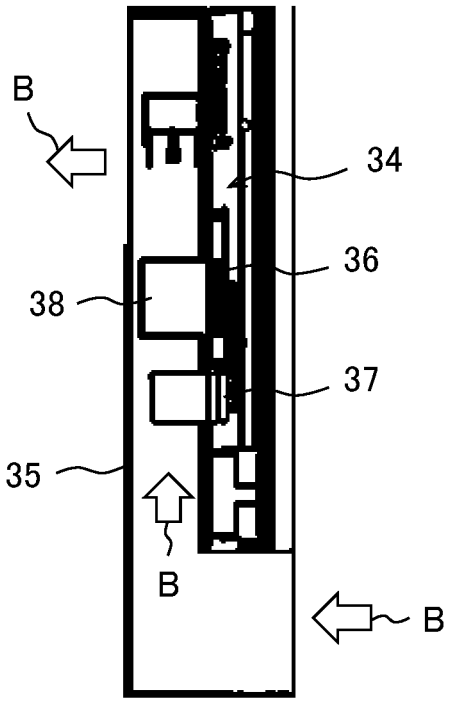
FIG. 10 is a partially enlarged view of portion X of FIG. 2.
Figure 11:
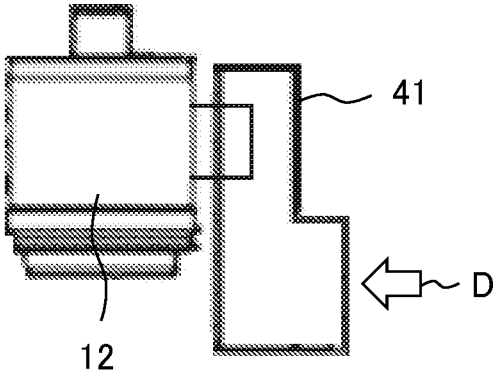
FIG. 11 is a vertical sectional view of a suction duct taken along a line XI-XI of FIG. 6.

As shown in FIG. 10, the cooling duct 35 is composed of a portion adjacent to the lower side of the control panel 34 and extending in the horizontal direction from the cooling air inlet 8B, and a portion adjacent to the left-hand side of the control panel 34 and extending in the vertical direction toward the suction side of the turbo fan 30. As shown in FIG. 6, an inlet 39 of the cooling duct 35 is large enough to correspond to the major portion of the cooling air inlet 8B. As shown in FIG. 2, the outlet of the cooling duct 35 is situated at a height corresponding to the motor 14 of the body unit 11, and has a size corresponding to the projection plane in the horizontal direction of the motor 14. The cooling air taken in at the major portion of the cooling air inlet 8B flows (is guided) through the cooling duct 35 (in other words, flows along the control panel 34) to cool the control panel 34 (see arrows B in FIGS. 10, 13, and 14).

Figure 14:
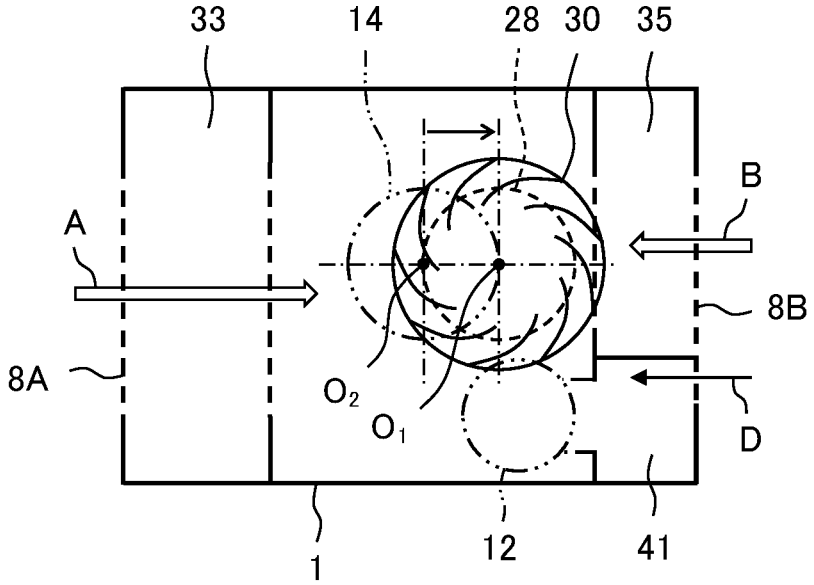
FIG. 14 is a plan view schematically illustrating the positional relationship of a fan duct suction port, a motor, cooling air inlets, etc. in the embodiment of the present invention.

In the upper portion of the machine chamber 10, the cooling air having flowed through the cooling duct 35 joins the cooling air from the introduction duct 33, and heads for the suction port 28 of the fan duct 27. Here, a feature of the present embodiment is that, as shown in FIG. 14, the center position $O_1$ of the suction port 28 of the fan duct 27 is offset away from the cooling air inlet 8A and toward the cooling air inlet 8B with respect to the center position $O_2$ of the drive shaft 16 of the motor 14 (in other words, the center position of the rotation shaft of the male rotor 20A of the compressor body 13). The offset width is, for example, approximately the radius of the motor 14.

Figure 12:
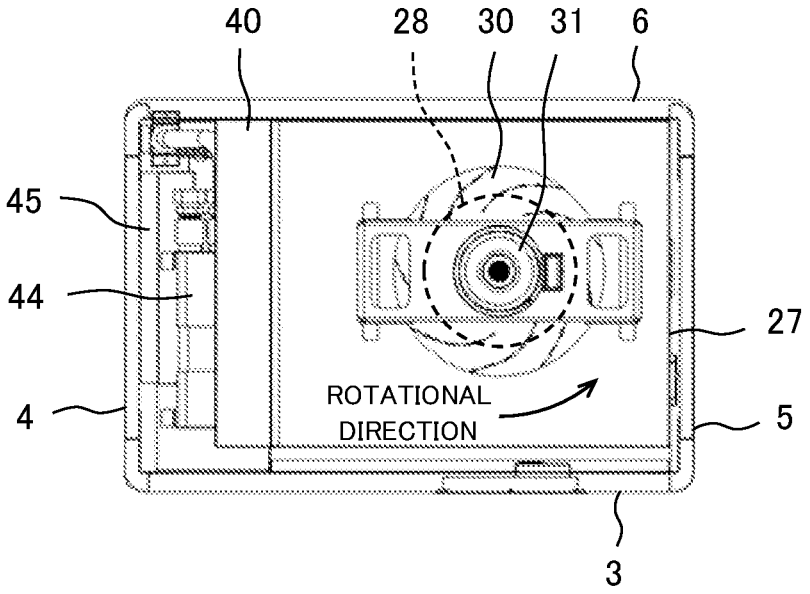
FIG. 12 is a horizontal sectional view of the package-type compressor taken along a line XII-XII of FIG. 2.
Figure 13:
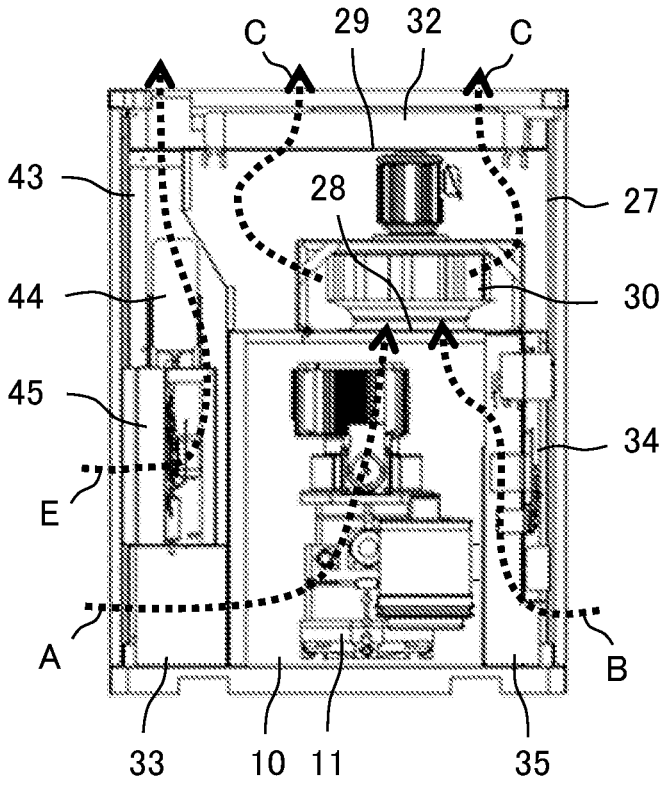
FIG. 13 is a vertical sectional view illustrating the cooling air flow in the package-type compressor according to the embodiment of the present invention.

The rotation shaft of the turbo fan 30 is arranged concentrically with the suction port 28 of the fan duct 27. As shown in FIG. 14, when the turbo fan 30 is projected in the vertical direction, the turbo fan 30 partially overlaps the motor 14 and, at the same time, the turbo fan 30 partially overlaps the cooling duct 35. Further, as shown in FIG. 12, the turbo fan 30 is arranged so as to be closer to the right-hand side plate of the fan duct 27 than to the left-hand side plate on the opposite side thereof, and as to be closer to the back plate of the fan duct 27 (in other words, the side plate adjacent to the right-hand side plate of the fan duct 27 in the rotational direction of the turbo fan 30) than to the front plate on the opposite side thereof. The left-hand side plate of the fan duct 27 has an inclined surface 40 inclined with respect to the vertical direction. As a result, the swirl flow in the fan duct 27 is mitigated, and an upward flow heading for the heat exchanger 32 is generated.

On the front side of the cooling duct 35, there is arranged a suction duct 41 so as to be adjacent thereto, and this suction duct 41 is connected to the suction side of the compressor body 13 via the suction filter 12. As shown in FIG. 6, an inlet 42 of the suction duct 41 is of a size large enough to correspond to the minor portion of the cooling air inlet 8B. Air is sucked into the compressor body 13 from the minor portion of the cooling air inlet 8B via the suction duct 41 and the suction filter 12 (see arrows D in FIGS. 11 and 14).

On the left-hand side of the machine chamber 10 and the fan duct 27 and on the upper side of the introduction duct 33, there is formed a dryer chamber 43, and this dryer chamber 43 is cut off from the machine chamber 10. The dryer chamber 43 accommodates a dryer 44 drying the compressed air, which is generated by the body unit 11 and cooled by the air cooler, through heat exchange with the cooling air (in other words, a heat exchanger removing drain from the compressed air). Further, the dryer chamber 43 accommodates a dryer cooling fan 45 (propeller fan) and a dryer fan motor driving this cooling fan 45. The dryer cooling fan 45 is arranged opposite the cooling air inlet 8C, and, as indicated by an arrow E of FIG. 13, induces a cooling air flow in the dryer chamber 43 (a cooling air flow taken in through the cooling air inlet 8C and discharged through the cooling air outlet 9). As a result, the dryer 44 is cooled. That is, the dryer chamber 43 functions as a duct for the dryer 44.

Next, the effects of the present embodiment will be described.

In the present embodiment, the cooling air inlets 8A and 8B are respectively formed in the left-hand side panel 4 and the right-hand side panel 5 of the casing 1, so that, as compared with the case where the cooling air inlet is formed solely in one side surface of the casing 1, it is possible to increase the total area of the cooling air inlets 8A and 8B. Further, the cooling air flow path extending from the cooling air inlet 8A to the cooling air outlet 9 via the introduction duct 33, the machine chamber 10, and the fan duct 27, and the cooling air flow path extending from the cooling air inlet 8B to the cooling air outlet 9 via the cooling duct 35, the upper portion of the machine chamber 10, and the fan duct 27 are relatively short, and the pressure loss of the cooling air flow path is relatively small. Thus, it is possible to increase the flow rate of the cooling air cooling the body unit 11 and the flow rate of the cooling air cooling the control panel 34. Thus, it is possible to achieve an improvement in terms of the cooling performance for cooling the body unit 11 and the control panel 34. Further, it is also possible to improve the cooling performance for cooling the heat exchanger 32.

Further, the center position $O_1$ of the suction port 28 of the fan duct 27 is offset with respect to the center position $O_2$ of the drive shaft 16 of the motor 14, whereby it is possible to attain a balanced state in terms of the flow rate of the cooling air at the cooling air inlet 8A and the cooling air inlet 8B. In particular, the former center position is offset with respect to the latter center position so as to be away from the cooling air inlet 8A and toward the cooling air inlet 8B, whereby it is possible to increase the flow rate of the cooling air cooling the control panel 34 to improve the cooling performance for cooling the control panel 34 without impairing the cooling performance for cooling the body unit 11. Generally speaking, a control panel includes a lot of components vulnerable to heat, so that a dedicated cooling fan for the control panel is often installed. According to the present embodiment, it is possible to secure a sufficient cooling air amount for the control panel 34, making it possible to advantageously eliminate the installation cost of such a dedicated fan. That is, there is no need to provide a dedicated fan or the output power of the dedicated fan is reduced, whereby it is possible to achieve a reduction in cost.

Further, the center position $O_1$ of the suction port 28 of the fan duct 27 is offset with respect to the center position $O_2$ of the drive shaft 16 of the motor 14, whereby it is possible to diminish the distance in the height direction between the suction port 28 of the fan duct 27 and the motor 14. This helps to achieve a reduction in the size of the package-type compressor.

Further, in the present embodiment, the dryer chamber 43 is provided between the compressor body 13 and the left-hand side panel 4, and the control panel 34 and the cooling duct 35 are provided between the compressor body 13 and the right-hand side panel 5, whereby it is possible to enhance the sound insulation effect.

Figure 15:
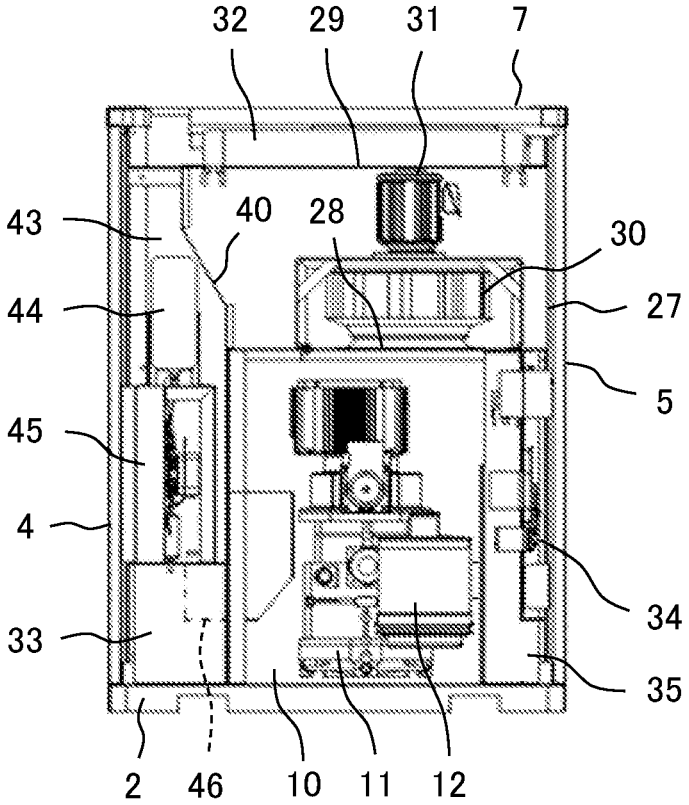
FIG. 15 is a vertical sectional view of a package-type compressor according to a first modification of the present invention.
Figure 16:
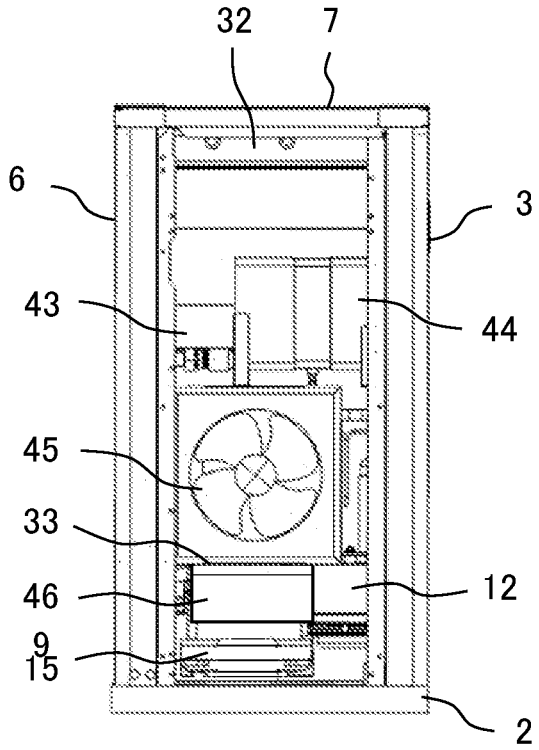
FIG. 16 is a left-hand side view of the package-type compressor according to the first modification of the present invention with a left-hand side panel removed.
Figure 17:
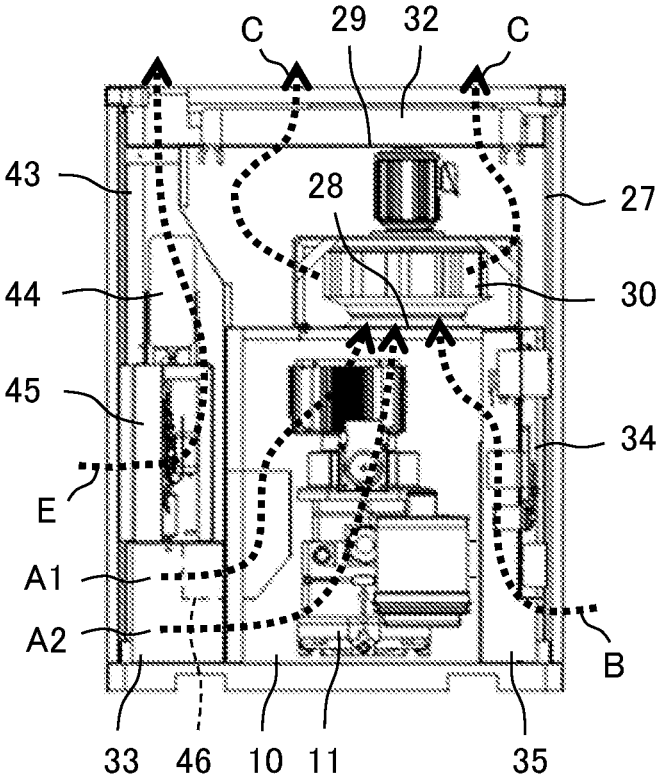
FIG. 17 is a vertical sectional view illustrating the cooling air flow in the package-type compressor according to the first modification of the present invention.

Although not described in particular in connection with the above embodiment, as in the case of a first modification shown in FIGS. 15 through 17, a guide 46 may be provided so as to be astride the introduction duct 33 and the machine chamber 10. As shown in FIG. 16, the guide 46 has substantially the same width dimension as the width dimension of the body unit 11. Further, as shown in FIG. 15, the guide 46 has a horizontal plate extending from the introduction duct 33 toward the lower portion (more specifically, the oil separator 15) of the body unit 11, and an inclined plate and a vertical plate extending from the lower portion to the middle portion (more specifically the compressor body 13) of the body unit 11.

As shown in FIG. 17, the guide 46 effects division into a flow supplying cooling air from the cooling air inlet 8A toward the lower portion of the body unit 11 (see an arrow A1), and a flow supplying cooling air from the cooling air inlet 8A toward the upper portion (more specifically, the motor 14) of the body unit 11 (see an arrow A2). As a result, it is possible to supply cooling air at lower temperature to the upper portion of the body unit 11, making it possible to enhance the cooling performance for the upper portion of the body unit 11. Further, the guide 46 interrupts the noise of the compressor body 13, so that it is possible to suppress sound leakage from the cooling air inlet 8A.

Figure 18:
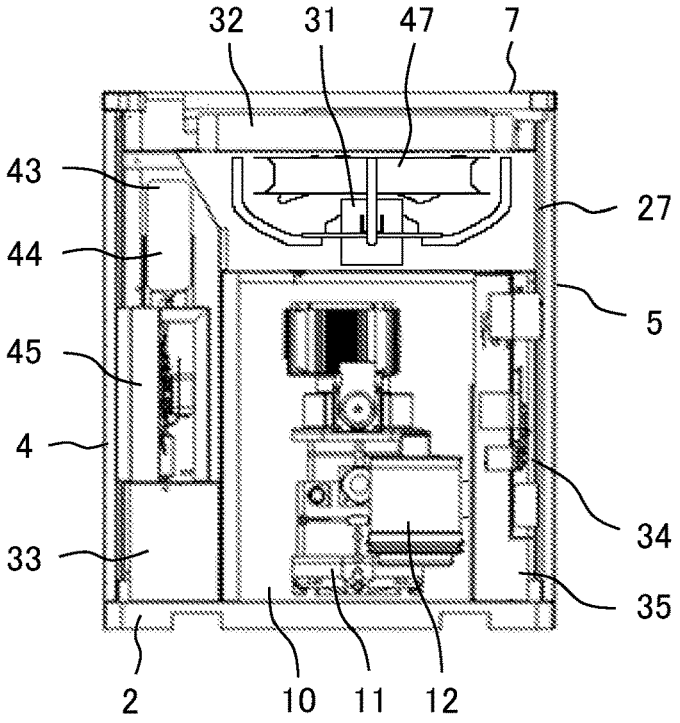
FIG. 18 is a vertical sectional view of a package-type compressor according to a second modification of the present invention.

While in the embodiment described above the turbo fan 30 (centrifugal fan) is provided as the cooling fan in the fan duct 27, this should not be construed restrictively. The embodiment allows modification without departing from the scope of the gist and technical idea of the present invention. As in the case of a second modification shown in FIG. 18, there may be provided a propeller fan 47 (an axial flow fan) the rotation shaft of which extends in the vertical direction. This helps to diminish the height dimension of the fan duct 27 and, by extension, the height dimension of the package-type compressor.

Figure 19:
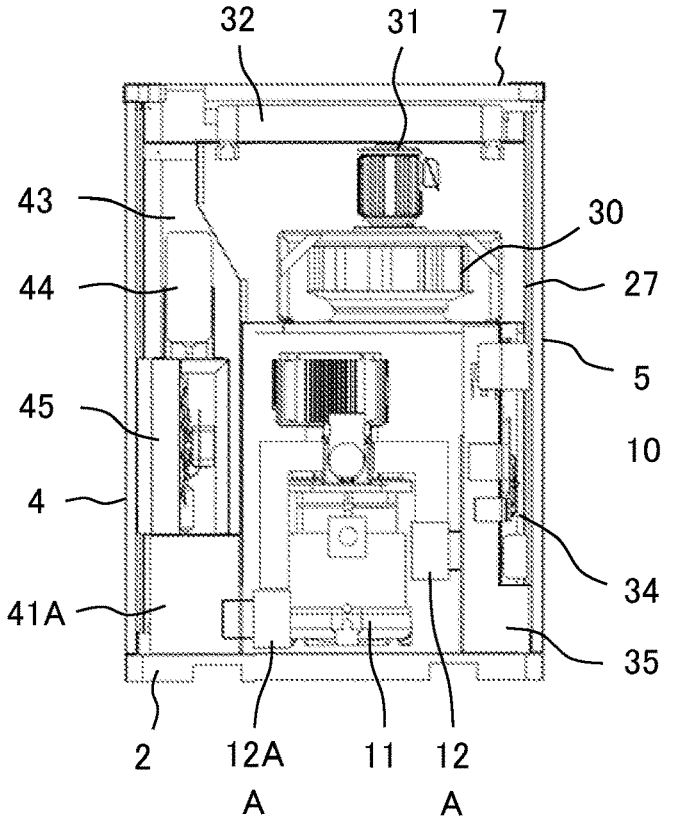
FIG. 19 is a vertical sectional view of a package-type compressor according to a third modification of the present invention.

Further, while in the embodiment described above there is provided one suction system connected to the suction side of the compressor body 13 (more specifically, the suction duct 41 and the suction filter 12), this should not be construed restrictively. The embodiment allows modification without departing from the scope of the gist and technical idea of the present invention. As in the case of a third modification shown in FIG. 19, it is also possible to provide one side suction system (more specifically, the suction duct 41 and the suction filter 12) and the other side suction system (more specifically, a suction duct 41A and a suction filter 12A), which are separately connected to the suction side of the compression body 13. That is, the suction duct 41A may be provided so as to be adjacent to front side of the introduction duct 33, and the suction duct 41A may be connected to the suction side of the compressor body 13 via the suction filter 12A. In the present modification, the suction filter is divided and diminished in size, whereby it is possible to enhance the degree of freedom in terms of the apparatus layout in the machine chamber 10 and to achieve a reduction in the size of the package-type compressor.

Figure 20:
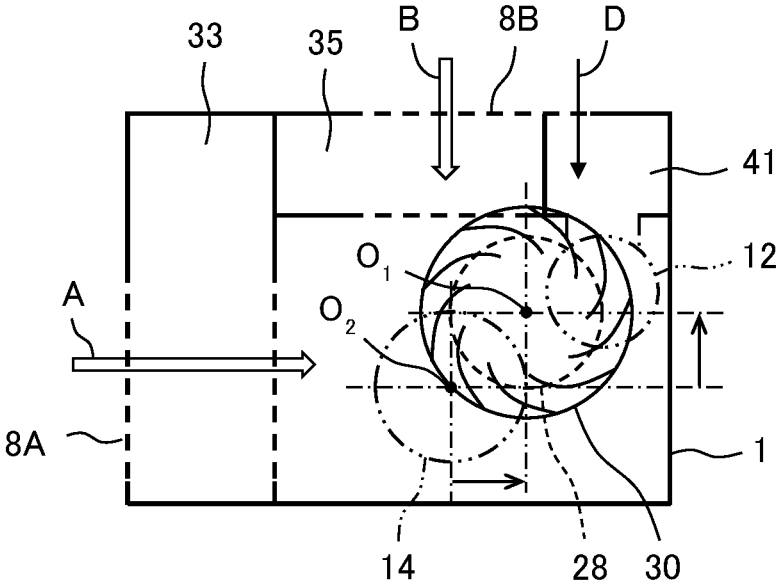
FIG. 20 is a plan view schematically illustrating the positional relationship of a fan duct suction port, a motor, cooling air inlets, etc. in a fourth modification of the present invention.

Further, while in the embodiment described above the cooling air inlet 8A is formed in the left-hand side surface of the casing 1 and the cooling air inlet 8B is formed in the right-hand side surface on the opposite side of the left-hand side surface of the casing 1, this should not be construed restrictively. The embodiment allows modification without departing from the scope of the gist and technical idea of the present invention. As in the case of a fourth modification shown in FIG. 20, the cooling air inlet 8A may be formed in the left-hand side surface of the casing 1, and the cooling air inlet 8B may be formed in the back surface adjacent to the left-hand side surface of the casing 1. That is, the control panel 34 and the cooling duct 35 may be arranged on the back side of the machine chamber 10. Further, the suction filter 12 and the suction duct 41 may be arranged on the back side of the machine chamber 10. Also in these modifications, the center position $O_1$ of the suction port 28 of the fan duct 27 is offset so as to be away from the cooling air inlet 8A and toward the cooling air inlet 8B with respect to the center position $O_2$ of the drive shaft 16 of the motor 14, whereby it is possible to attain the same effect as that of the above embodiment.

Further, while in the embodiment described above the body unit 11 has the oil feeding type compressor body 13 supplying oil into the suction flow path or the compression chamber, and the oil separator 15 separating oil from the compressed air delivered from the compressor body 13, with the motor 14 being integrated with the compressor body 13 and the oil separator 15, this should not be construed restrictively. The embodiment allows modification without departing from the scope of the gist and technical idea of the present invention. For example, there may be provided a water feeding type compressor body supplying water into the suction flow path or the compression chamber, and a water separator (a gas-liquid separator) separating water from the compressed air delivered from the compressor body, with the motor being integrated with the compressor body and the water separator. Further, for example, there may be provided a compressor body not supplying oil or water into the suction flow path or the compression chamber, with the motor being integrated with this compressor body (that is, the gas-liquid separator may not be provided). Also in these cases, it is possible to attain the same effect as that of the above embodiment.

Further, while in the embodiment described above the compressor body 13 has the two screw rotors 20A and 20B, this should not be construed restrictively. That is, it may also have a single screw rotor or a tri-rotor. Further, the rotor is not restricted to a screw type one. For example, it may also be a scroll type, a vane type or the like. Further, while in the embodiment described above the compressor body 13 compresses air, this should not be construed restrictively. It may compress some other gas than air.

Further, while in the embodiment described above the motor 14 is an axial gap type motor (more specifically, a motor equipped with motor rotors 17A and 17B spaced away from each other in the axial direction of the drive shaft 16 and a stator 18), this should not be construed restrictively. For example, it may also be a radial gap type motor (more specifically, a motor equipped with a motor rotor and a stator that are spaced away from each other in the radial direction of the drive shaft).

Further, while in the embodiment described above there are provided the dryer 44 and the dryer cooling fan 45 and the cooling air inlet 8C is formed in the left-hand side panel 4, this should not be construed restrictively. That is, the dryer 44 and the dryer cooling fan 45 may not be provided, and the cooling air inlet 8C may not be formed in the left-hand side panel 4.

DESCRIPTION OF REFERENCE CHARACTERS

1: Casing
8A: Cooling air inlet (first cooling air inlet)
8B: Cooling air inlet (second cooling air inlet)
9: Cooling air outlet
10: Machine chamber
11: Body unit
13: Compressor body
14: Motor
15: Oil separator (gas-liquid separator)
16: Drive shaft
27: Fan duct
28: Suction port
29: Delivery port
30: Turbo fan (cooling fan)
32: Heat exchanger
34: Control panel
35: Cooling duct
40: Inclined surface
43: Dryer chamber
44: Dryer
45: Dryer cooling fan
46: Guide
47: Propeller fan (cooling fan)

The invention claimed is:

1. A compressor comprising:

a body unit having a compressor body compressing a gas and a motor driving the compressor body;

a controller controlling the motor;

a casing accommodating the body unit and the controller at a lower portion thereof;

a first cooling air inlet formed in one side surface of the casing;

a second cooling air inlet formed in another side surface of the casing;

a cooling air outlet formed in an upper surface of the casing;

a fan duct provided at an upper portion of the casing and having a suction port at a lower surface and a delivery port at an upper surface;

a cooling fan accommodated in the fan duct and arranged such that a rotation shaft extends in a vertical direction, the cooling fan inducing a flow of cooling air taken in through the first and second cooling air inlets and discharged through the cooling air outlet;

an air cooling heat exchanger arranged above the delivery port of the fan duct and below the cooling air outlet;

a machine chamber provided below the fan duct and accommodates the body unit, the machine chamber causing the cooling air taken in at the first cooling air inlet to flow along the body unit toward the suction port of the fan duct; and a cooling duct provided below the fan duct, the cooling duct causing the cooling air taken in at the second cooling air inlet to flow along the controller toward the suction port of the fan duct, wherein a vertical projection plane of the cooling fan overlaps the machine chamber and the cooling duct.

2. The compressor according to claim 1, wherein the second cooling air inlet is formed in a side surface on an opposite side of the one side surface of the casing in which the first cooling air inlet is formed.

3. The compressor according to claim 1, wherein the side surface in which the second cooling air inlet is open is a side surface on an opposite side with respect to the side surface in which the first cooling air inlet is open, with the body unit sandwiched therebetween.

4. The compressor according to claim 1, further comprising a guide that divides the flow of cooling air into two flows: a flow that supplies cooling air from the first cooling air inlet toward a lower portion of the body unit; and a flow that supplies cooling air from the first cooling air inlet toward an upper portion of the body unit.

5. The compressor according to claim 1, wherein the cooling fan is a turbo fan that is arranged so as to be closer to one side surface of the fan duct than to a side surface on an opposite side thereof and so as to be closer to another side surface of the fan duct than to a side surface on an opposite side of the another side surface, the another side surface being adjacent to the one side surface of the fan duct in a rotational direction of the turbo fan, and the side surface on the opposite side of the one side surface of the fan duct has an inclined surface inclined with respect to the vertical direction.

6. The compressor according to claim 1, further comprising a suction duct connected to a suction side of the compressor body, wherein a gas is sucked into the compressor body from the second cooling air inlet via the suction duct.

7. The compressor according to claim 1, further comprising one side and other side suction ducts that are connected to a suction side of the compressor body, wherein a gas is sucked into the compressor body from the second cooling air inlet via the one side suction duct, and a gas is sucked into the compressor body from the first cooling air inlet via the other side suction duct.

8. The compressor according to claim 1, further comprising:

a dryer that dries a compressed air generated in the body unit and cooled by the heat exchanger;

a dryer cooling fan that generates a cooling air cooling the dryer; and a dryer chamber cut off from the machine chamber and accommodating the dryer and the dryer cooling fan.

9. The compressor according to claim 8, further comprising:

a third cooling air inlet open above the first cooling air inlet;

another duct forming the dryer chamber and guiding cooling air taken in at the third cooling air inlet to a position above a discharge side of the cooling fan.

10. The compressor according to claim 1, further comprising a gas-liquid separator separating oil or water from a compressed gas delivered from the compressor body.

11. A compressor including a body unit having a compressor body and a motor that drives the compressor body, a casing accommodating the body unit, and a cooling fan arranged above the body unit and configured to take in external air to generate a cooling air flowing through the casing upwardly from the body unit side, the compressor comprising:

a first inlet port open in a lower portion side of a side surface of the casing and configured to taken in cooling air flowing from the body unit side toward a suction side of the cooling fan;

a second inlet port open in a side surface of the casing different from the side surface in which the first inlet port is open;

a duct extending toward the suction side of the cooling fan and between the second inlet port and the body unit and guiding the cooling air taken in at the second inlet port toward the cooling fan; and a controller arranged above the second inlet port and inside the duct and controlling the motor, wherein at least a part of each of the body unit and the outlet of the duct is included in a vertical projection plane of the cooling fan.

12. The compressor according to claim 11, wherein the side surface in which the second inlet port is open is a side surface on an opposite side with respect to the side surface in which the first inlet port is open, with the body unit sandwiched therebetween.

13. The compressor according to claim 11, further comprising:

a third inlet port open above the first inlet port;

another duct guiding cooling air taken in at the third inlet port to a position above a discharge side of the cooling fan;

a heat exchanger arranged in the other duct and configured to remove drain from a compressed gas delivered from the body unit; and another cooling fan generating a cooling air flowing into the other duct.

14. The compressor according to claim 11, further comprising a gas-liquid separator separating oil or water from a compressed gas delivered from the compressor body.

* * * * *